United States Patent [19]

Petschner

[11] Patent Number: 4,710,967

[45] Date of Patent: Dec. 1, 1987

[54] DOUBLE-WALL SACK MADE OF CIRCULAR-WOVEN TUBE WITH GATHERED LOOP

[75] Inventor: Goetz Petschner, Zollikon, Switzerland

[73] Assignee: IMAG-Verlage AG fur Immaterialguterrecht, Zug, Switzerland

[21] Appl. No.: 930,980

[22] Filed: Nov. 13, 1986

Related U.S. Application Data

[63] Continuation of Ser. No. 665,639, Oct. 29, 1984, abandoned.

[30] Foreign Application Priority Data

Nov. 9, 1983 [CH] Switzerland ..... 6032/83

[51] Int. Cl.[4] ..... B65D 33/10

[52] U.S. Cl. ..... 383/8; 206/806; 383/24; 383/27; 383/111; 383/114

[58] Field of Search ..... 383/7, 10, 6, 24, 109, 383/114, 115, 27, 71, 77, 8, 111; 206/806

[56] References Cited

U.S. PATENT DOCUMENTS

| | | | |
|---|---|---|---|
| 718,053 | 1/1903 | Gregory | 383/72 X |
| 1,841,891 | 1/1932 | Hardy | 383/6 X |
| 2,037,175 | 4/1936 | Northcross | 383/37 X |
| 2,318,735 | 5/1943 | Bickford | 383/22 X |
| 2,731,142 | 1/1956 | Miley | 383/7 X |
| 2,731,998 | 1/1956 | Hams, Jr. | 383/117 X |
| 2,897,863 | 8/1959 | Somers, Jr. | 383/22 |
| 3,485,281 | 12/1969 | Wicks | 383/111 X |
| 3,789,897 | 2/1974 | Saito | 383/67 X |
| 4,136,723 | 1/1979 | Skaadel | 383/7 |
| 4,194,652 | 3/1980 | Williamson et al. | 383/67 X |
| 4,223,709 | 9/1980 | Myklebust | 383/7 |
| 4,269,247 | 5/1981 | Omdal | 383/71 X |
| 4,353,196 | 10/1987 | Beer et al. | 383/8 X |
| 4,466,214 | 8/1984 | Kirkhaim, Jr. | 383/120 X |
| 4,503,559 | 3/1985 | Warnke | 383/117 X |
| 4,584,705 | 4/1986 | Myklebust et al. | 383/8 |
| 4,628,535 | 12/1986 | Tetenborg | 383/24 |

FOREIGN PATENT DOCUMENTS

| | | | |
|---|---|---|---|
| 0102164 | 10/1964 | Denmark | 383/8 |
| 0041586 | 5/1980 | European Pat. Off. . | |
| 0080926 | 6/1983 | European Pat. Off. | 206/806 |
| 1516010 | 3/1968 | France | 383/10 |
| 0205862 | 10/1923 | United Kingdom | 383/75 |
| 2149382 | 6/1985 | United Kingdom | 383/8 |

OTHER PUBLICATIONS

Packaging Review, Dec. 1980.

*Primary Examiner*—George E. Lowrance
*Assistant Examiner*—Bryon Gehman
*Attorney, Agent, or Firm*—Karl F. Ross; Herbert Dubno; Andrew Wilford

[57] ABSTRACT

A container or bag or sack essentially comprises a tubular fabric, in particular a circular fabric of polyolefines, having a double wall formed by turning in or partially inverting the tubular fabric. In addition, a cut extending downwardly from the folded or turned in edge is provided in the double wall, and the folded or turned in edge thus cut open is gathered or tucked all the way around such that this gathered inner wall-sections of the double wall form a suspension or hanging loop. A suspension loop is thus formed in a relatively simple manner. Practically all the warp threads of the circular fabric unite in the suspension loop, imparting to the sack possessing a load-carrying strength at least equivalent to the tensile strength of the fabric. The lifting strength of the suspension loop is considerably increased by the gathering.

5 Claims, 6 Drawing Figures

DOUBLE-WALL SACK MADE OF CIRCULAR-WOVEN TUBE WITH GATHERED LOOP

This is a continuation of co-pending application Ser. No. 665,639 filed on 29 Oct. 1984, now abandoned.

BACKGROUND OF THE INVENTION

The present invention relates to a container such as a bag or sack made essentially of a tubular fabric, especially a circular fabric of polyolefines.

Generally speaking, the bag or sack of the present invention is for the suspended support of bulk materials and comprises a closed bottom, a suspension loop and a tubular wall portion extending between the closed bottom and the suspension loop.

Sacks made of a circular fabric have proved to be suitable packaging material in many ranges of application. For this purpose, in addition to jute as a sack material, synthetic materials and especially polyolefines, for instance polypropylene (PP) or polyethylene (PE), in the form of flat narrow woven or fabric tapes are generally adopted. Sacks made of such fabrics are chemical-resistant, unsusceptible to water, hygienic, non-decomposable and have good breathing properties.

In order that such woven sacks can also be utilized for the most finely grained materials as well as for hygroscopic bulk materials, such as cement, it is known per se to insert an inner sack of moisture-proof material, for instance a blown polyethylene film, into the woven sack.

In many cases it is desirable for such known sacks, with or without an inner sack, to also be able to be used in the dimensions of the containers' scope with a filling material having a weight of, for example, 1000 kilogrammes and more. As far as the resistance to tearing of the material used for manufacturing such sacks is concerned, there are no problems, whereas the carrying capacity of such containers is extremely limited by the hithereto known, as a rule sewn-on, loop means for transporting the container by means of lifting device, such as a crane or the like. If, on the other hand, the loop means are girted, the ensuing production costs are no longer economical.

Therefore, with the foregoing in mind, it is a primary object of the present invention to provide a new and improved construction of a container such as a bag or sack of the previously mentioned typed which does not exhibit the aforementioned drawbacks and shortcomings of the prior art constructions and method of fabricating such container.

SUMMARY OF THE INVENTION

Another and more specific object of the present invention a new and improved to provide a new and improved construction of a container of the previously mentioned type having means that permit the container to be suspended on the hook of a crane or the like with considerably more than adequate safety. Still another object of the present invention aims at providing a new and improved construction of a container of the previously mentioned typed whose manufacture requires neither sewing nor girting.

Yet a further significant object of the present aims at providing a new and improved construction of a container of the character described which is relatively simple in construction and design, extremely economical to manufacture, highly reliable in operation, not readily subject to break-down or malfunction and requires a minimum of maintenance and servicing. Now in order to implement these and still further objects of the invention, which will become more readily apparent as the description proceeds, the container such as a bag or sack of the present invention is manifested by the features that the container is made essentially of a tubular fabric, especially a circular fabric of polyolefines, having double walls formed by turning in or partially inverting the tubular fabric, whereby a cut extending downwardly from the folded or turned in edge is provided in the double wall, and the folded or turned in edge thus cut open is gathered all the way around, and whereby the thus gathered turndown edge and the associated gathered inner wall-sections of the double wall form a suspension loop.

In other words, the container of the present invention is manifested by the features that the tubular wall portion comprises an inner fabric layer having warp members extending up from the closed bottom to the suspension loop within the inner fabric layer. The tubular wall portion also comprises an outer fabric layer formed by folding an extension of the inner fabric layer back over itself such that continuous extensions of the warp members extend from the suspension loop down to the closed bottom within the outer fabric layer. The tubular wall portion is provided with a slit extending substantially parallel to the warp members downward from the suspension loop toward the closed bottom for a predetermined distance. This predetermined distance defines an inside diameter of the suspension loop.

By means of these measures in accordance with the invention, a suspension loop is formed in a relatively simple manner, in which practically all the warp threads of the circular fabric join or unite, imparting a load-carrying strength to the container which is at least equivalent to that of the sack, whereby the lifting strength on the suspension loop is considerably increased by the gathering; all of which is achieved without sewing and without further loop and belt means. A further advantage is found in that such containers can be manufactured in situ—used, provided that suitable pieces of tubular, respectively circular, fabric are available.

In order to prevent the suspension loop from splitting open, it is advantageous for the partially limiting gathered folded or turned in edge of the suspension loop to have a tape shrouding.

A further advantage of the invention in accordance with the claims is achieved in that the inside width of the suspension loop is essentially determined by the depth of the cut in the double wall.

In order that such containers in accordance with the invention can also be utilized for the most finely grained materials as well as hygroscopic materials, a further development of the container in accordance with the invention consists in that the double wall surrounds an inner sack that is made essentially of polyolefine film, especially polyethylene film, whereby it is of advantage for the filling end of the inner sack to protrude laterally out of the double-walled outer sack through the cut.

Moreover, in order to give the container in accordance with the invention the desired strength at the bottom, a further advantageous development consists in that the double wall is unbinded or joined or gathered and tied, if necessary with the inner sack, at the bottom of the container.

An advantageous development of the container in accordance with the invention, relating to its strength and stability, is obtained if the container exists, moreover, if this is made of a circular fabric of narrow polypropylene or polyethylene tapes.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

Figure 1:
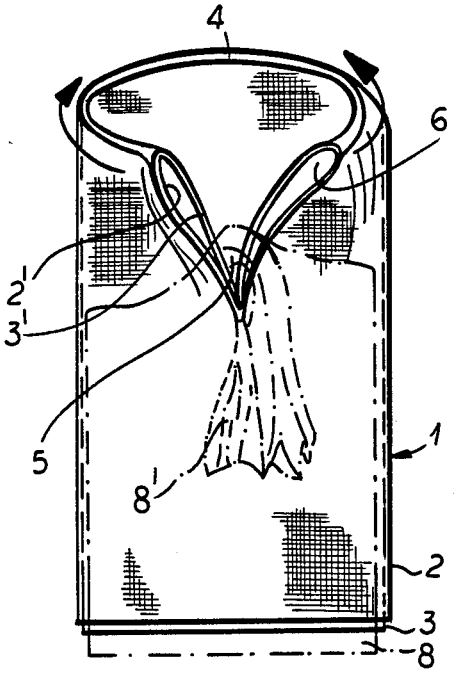
FIG. 1 schematically represents the container according to the invention formed by turning in one of the wall portions of a tubular fabric.

Describing now the drawings, it is to be understood that to simplify the showing thereof only enough of the structure of the container such as a bag or sack has been illustrated therein as needed to enable one skilled in the art to readily understand the underlying principles and concepts of this invention. Turning now to specifically to FIG. 1 of the drawings, the bag or sack illustrated therein by way of example and not limitation will be seen to comprise a double-walled tubular structure open at the top and at the bottom. The first stage in the manufacture of a container 1 in accordance with the invention is to fold in or turn down a tubular fabric in such a manner that a double wall of approximately equal length to the tubular or circular-fabric parts or wall portions 2 and 3 is formed. Then from the folded or turned in edge 4 a cut 5 is made in the double wall 2,3.

If an inner sack 8 is to be provided, it can be inserted into the outer sack 2,3 prior to making the cut 5. After making the cut 5, the filling end 8' of the inner sack 8 is drawn laterally out of the outer sack formed by the double wall 2,3, through the cut 5, as is indicated in FIG. 1 by the dot-and-dash line.

Figure 2:
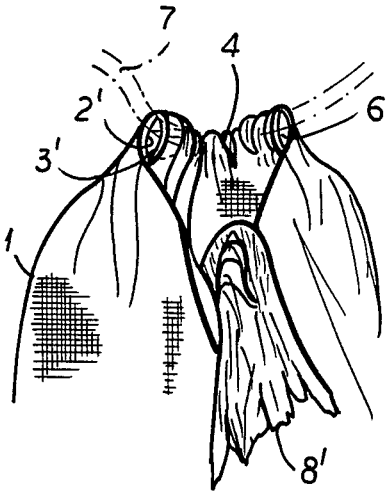
FIG. 2 diagrammatically represents on an enlarged scale the turned in edge of the container according to FIG. 1, in an initial phase of the formation of the suspension loop.
Figure 3:
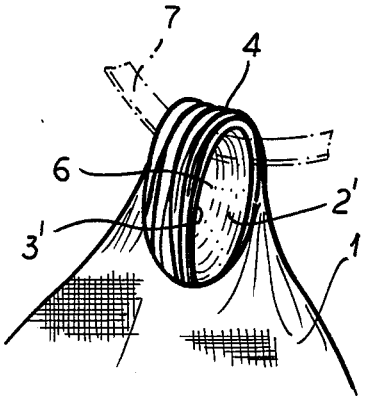
FIG. 3 shows the arrangement according to FIG. 2 with completely gathered suspension loop.

Subsequently the suspension loop 6 is formed by gathering the folded or turned in edge 4 all the way around FIG. 2 shows an intermediate phase and FIG. 3 the final phase of this procedure.

This gathering of the folded or turned in edge 4 from the two cut edges of the cut 5 can be facilitated if, initially or during the intermediate phase illustrated in FIG. 2, a tape 7 is placed in the inside of the folded or turned in edge with the gathered inner wall-sections 2' and 3' of the double wall 2,3, which then limits or defines the suspension loop 6.

Figure 4:
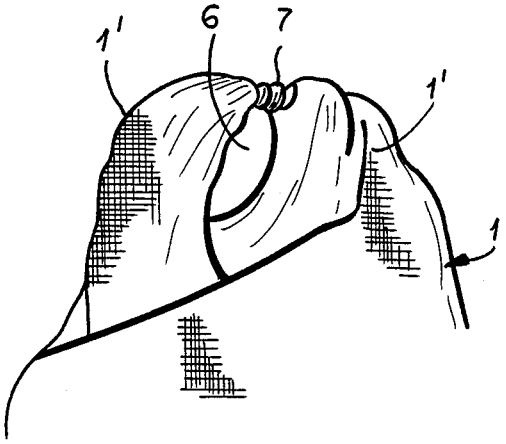
FIG. 4 is a diagrammatically represents of the finished suspension loop of the container in accordance with the invention.

This tape 7 or another similar tape can serve as a taping or surrounding of the partially limiting gathered folded or turned in edge of the suspension loop 6 in order to prevent the gathering from splitting open. This tape shrouding 7 can be seen particularly clearly in FIG. 4. Moreover, FIG. 4 clearly illustrates that all of the warp threads 1' of the double wall 2,3 interfuse or write in the suspension loop 6.

Moreover, it can be seen in FIGS. 1 to 4 that the aperture width of the suspension loop 6 is essentially determined by the depth of the cut 5 in the double wall 2,3.

Figure 5:
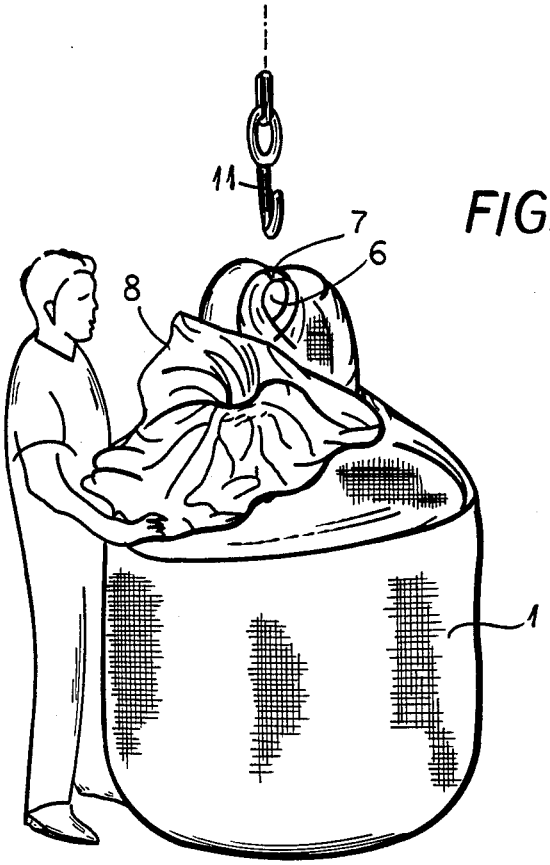
FIG. 5 is a diagrammatically represents of the container in accordance with the invention, with a protruding inner sack.

FIG. 5 illustrates a container 1 with inner sack 8 filled with loose goods or materials and having a suspension loop 6 prepared for the insertion of a crane hook. The person positioned upright next to the container is only illustrative of a possible size of such a container.

Figure 6:
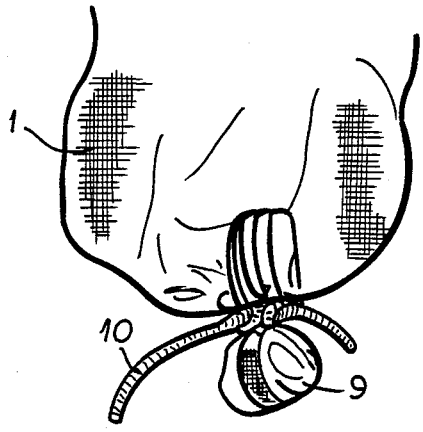
FIG. 6 is a diagrammatically represents of the bound up bottom of the container in accordance with the invention.

In the additional illustration of the container 1 in accordance with the invention in FIG. 6, it is indicated that the double wall is also gathered at the bottom, if necessary together with the inner sack, and then folded over, whereby the turned up portion thus formed is bound or tied by means of a rope. This is a simple measure for forming a container bottom of the highest possible load-carrying strength.

From the foregoing there ensues a container that meets up to all practical requirements imposed on such containers.

Such a container has an equally wide spectrum of applications both with and without an inner sack.

In this connection, the double wall 2,3 forming the outer sack can be made of a circular fabric of narrow polypropylene tapes, and the inner sack of a polyethylene film.

While there are shown and described present preferred embodiments of the invention, it is to be distinctly understood that the invention is not limited thereto, but may be otherwise variously embodied and practiced within the scope of the following claims. Accordingly,

What I claim is:

1. A sack comprising:

a circularly woven fabric tube having an outer portion and an inner portion unitarily joined thereto at a fold, the inner portion lying within the outer portion and extending the full length thereof from the fold, the portions having lower ends spaced from the fold;

means for connecting the lower ends together to form a sack bottom, the tube being formed with a single cut in both portions extending across the fold and toward the sack bottom, the cut forming a pair of adjacent openings between the portions; and means extending through the cut between the portions along the full length of the fold for gathering the tube to form a suspension loop and to form a filling mouth opening laterally at the openings into the inner portion.

2. The sack defined in claim 1, further comprising an inner bag of polyethylene film received in the tube and having a filling opening adapted to extend sideways from the tube through the mouth.

3. The sack defined in claim 2 wherein the connecting means binds the inner and outer portions together with the inner bag at the sack bottom.

4. The sack defined in claim 2 wherein the connecting means is a tie surrounding both portions and the inner bag at the sack bottom.

5. The sack defined in claim 1 wherein the means extending through the cut is a tape.

* * * * *